US008870560B2

(12) United States Patent
Hayashi

(10) Patent No.: US 8,870,560 B2
(45) Date of Patent: Oct. 28, 2014

(54) SYSTEM FOR PRODUCING NDFEB SYSTEM SINTERED MAGNET

(75) Inventor: Shinichi Hayashi, Kyoto (JP)

(73) Assignee: Intermetallics Co., Ltd., Nakatsugawa (JP)

( * ) Notice: Subject to any disclaimer, the term of this patent is extended or adjusted under 35 U.S.C. 154(b) by 127 days.

(21) Appl. No.: 13/696,496

(22) PCT Filed: May 9, 2011

(86) PCT No.: PCT/JP2011/060666
§ 371 (c)(1),
(2), (4) Date: Nov. 6, 2012

(87) PCT Pub. No.: WO2011/142321
PCT Pub. Date: Nov. 17, 2011

(65) Prior Publication Data

US 2013/0052290 A1 Feb. 28, 2013

(30) Foreign Application Priority Data

May 10, 2010 (JP) ..... 2010-108625

(51) Int. Cl.
*B30B 11/08* (2006.01)
*B22F 3/10* (2006.01)
*H01F 41/02* (2006.01)
*H01F 1/057* (2006.01)

(52) U.S. Cl.
CPC ..... *H01F 1/0577* (2013.01); *H01F 41/0266* (2013.01); *C22C 2202/02* (2013.01)
USPC ..... 425/78; 425/135; 425/140; 425/148; 264/40.4; 264/40.7

(58) Field of Classification Search
USPC ..... 425/78, 135, 140, 145, 148, 150, 345; 264/40.4, 40.5, 40.7
See application file for complete search history.

(56) References Cited

U.S. PATENT DOCUMENTS 6,155,028 A * 12/2000 Nagata et al. ..... 264/102
6,312,629 B1 * 11/2001 Gusack et al. ..... 264/37.29
(Continued)

FOREIGN PATENT DOCUMENTS

CN 1969347 A 5/2007
EP 0 900 645 A2 3/1999
(Continued)

OTHER PUBLICATIONS

Aug. 9, 2011 International Search Report issued in International Application No. PCT/JP2011/060666.
(Continued)

*Primary Examiner* — Joseph S Del Sole
*Assistant Examiner* — Thukhanh Nguyen
(74) *Attorney, Agent, or Firm* — Oliff PLC

(57) ABSTRACT

A NdFeB sintered magnet production system including: a first weight unit for measuring the mold weight when the alloy powder is not yet filled; a guide attachment unit to extend the mold cavity with a guide to form a supply cavity with a predetermined volume; a powder supply unit for supplying the alloy powder into the supply cavity so that the alloy powder volume is equal to the supply cavity capacity; a filling unit for pressing the alloy powder contained in the supply cavity into the mold cavity to densify the alloy powder to the filling density; a second weight unit for measuring the mold weight after being filled with the alloy powder; and a controlling unit for computing the alloy powder weight filled into the mold cavity based on the difference between the measurement value from each of the first weight unit and the second weight unit.

6 Claims, 2 Drawing Sheets

(56) References Cited

U.S. PATENT DOCUMENTS

| | | | | |
|---|---|---|---|---|
| 6,325,609 | B1 * | 12/2001 | Shimada | 425/140 |
| 6,475,430 | B1 * | 11/2002 | Nagata et al. | 419/38 |
| 7,797,076 | B2 * | 9/2010 | Isozumi et al. | 425/140 |
| 8,545,641 | B2 * | 10/2013 | Sagawa et al. | 148/103 |
| 2007/0245851 | A1 | 10/2007 | Sagawa et al. | |

FOREIGN PATENT DOCUMENTS

| | | | |
|---|---|---|---|
| EP | 1 788 594 | A1 | 5/2007 |
| JP | A-59-046008 | | 3/1984 |
| JP | A-07-040321 | | 2/1995 |
| JP | A-11-049101 | | 2/1999 |
| JP | A-2004-031873 | | 1/2004 |
| JP | A-2006-019521 | | 1/2006 |
| JP | A-2009-049202 | | 3/2009 |
| JP | A-2011-074419 | | 4/2011 |
| KR | 10-2007-0043782 | | 4/2007 |
| WO | WO 2006/004014 | A1 | 1/2006 |

OTHER PUBLICATIONS

Dec. 10, 2012 International Preliminary Report on Patentability issued in International Application No. PCT/JP2011/060666 (with translation).

May 30, 2014 Office Action issued in Chinese Patent Application No. 201180023690.7 (with partial English translation).

* cited by examiner

SYSTEM FOR PRODUCING NDFEB SYSTEM SINTERED MAGNET

TECHNICAL FIELD

The present invention relates to a system for producing a NdFeB system sintered magnet while the alloy powder is held in a filling container (mold), and without creating a compact.

BACKGROUND ART

NdFeB (neodymium-iron-boron) system sintered magnets were discovered in 1982 by Sagawa and other researchers. NdFeB system sintered magnets exhibit characteristics far better than those of conventional permanent magnets, and can be advantageously manufactured from raw materials such as Nd (a kind of rare earth element), iron, and boron, which are relatively abundant and inexpensive. Hence, NdFeB system sintered magnets are used in a variety of products, such as voice coil motors used in hard disks and other apparatus, driving motors for hybrid or electric cars, battery-assisted bicycle motors, industrial motors, high-grade speakers, headphones, and permanent magnetic resonance imaging systems.

Three methods have been previously known to be available for producing NdFeB system sintered magnets: (1) sintering method; (2) casting method including the process steps of casting, hot working and aging; and (3) die-upsetting method including the step of die upsetting a rapidly cooled alloy. Among these methods, the sintering method is superior to the other two methods in terms of the magnetic properties of the products and the productivity, and has already been established on the industrial level. With the sintering method, dense and uniform microstructures necessary for good permanent magnets can be obtained.

Patent Document 1 discloses a method for producing a NdFeB system sintered magnet by a sintering method. A brief description of this method is as follows: Initially, a NdFeB alloy is created by melting and casting. This alloy is pulverized into fine powder, and the fine powder is put into a mold. A magnetic field is applied to this alloy powder, while pressure is applied to the powder with a pressing machine. In this process, both the creation of a compact and the magnetic orientation of the compact are simultaneously performed. Subsequently, the compact is removed from the mold and heated for sintering to obtain a NdFeB system sintered magnet.

Fine powder of a NdFeB system alloy is easily oxidized and may ignite by reacting with oxygen in air. Therefore, the previously described process should preferably be performed entirely in an airtight container in which no oxygen is present or inert gas is filled. However, this is impractical because creating the compact requires a large-sized pressing machine capable of applying a high pressure of tens or hundreds MPa to the alloy powder. Such a pressing machine is difficult to be set within an airtight container.

Patent Document 2 discloses a method for producing a sintered magnet without using a pressing machine (i.e. without creating a compact). This method includes the three processes of filling, orienting and sintering, which are performed in this order to create a sintered magnet. A brief description of this method is as follows: In the filling process, an alloy powder is supplied into a mold, after which the density of the alloy powder in the mold is increased by a pushing, tapping or similar operation to a level of approximately 3.0-4.2 g/cm$^3$, which is higher than a natural filling density and lower than a density of the press compact. In the orienting process, a magnetic field is applied to the alloy powder, without applying any pressure, to orient the particles of the alloy powder in the mold in one direction. In the sintering process, the alloy powder which has been aligned in one direction in the orienting process is heated, together with the mold, to be sintered. In this method, since no pressure is applied to the alloy powder in the magnetic orienting process and the density of the alloy powder is lower than that of the compact in the press-molding process, the friction among the particles of the alloy powder is reduced. Accordingly, in the orienting process, the powder particles can be aligned with high degree of orientation. As a result, a NdFeB system sintered magnet with even higher magnetic properties is obtained.

Patent Document 2 also discloses a system for producing a sintered magnet using an airtight container in which no oxygen is present or inert gas is filled, and in which a filling unit, an orienting unit and a sintering unit are provided together with a conveyer for moving the filling container from the filling unit to the orienting unit and then from the orienting unit to the sintering unit. In this system, the alloy powder is handled under oxygen-free or inert-gas atmosphere throughout the entire process, so that the oxidization of the powder and the deterioration of magnetic properties due to the oxidization will not occur. Such a method in which no press compact is created, and in which the alloy powder is held in a mold until it is sintered into a magnet, will be hereinafter referred to as the "press-less process" or "PLP" method.

BACKGROUND ART DOCUMENT

Patent Document

[Patent Document 1] JP-A 59-46008
[Patent Document 2] JP-A 2006-19521
[Patent Document 3] JP-A 2009-49202
[Patent Document 4] JP-A 11-49101

DISCLOSURE OF THE INVENTION

Problem to be solved by the Invention

One of the advantages of the PLP method is its high "near-net-shape" molding (the capability of producing sintered magnets in a shape close to the final product). A "near-net-shape" sintered magnet can be manufactured using the PLP method by appropriately designing a mold and appropriately filling the mold with an alloy powder. In particular, the PLP method is advantageous in that the "near-net shape" quality can be maintained even in the production of a thin magnet that easily cracks and hence is difficult to be completed in the "near-net shape" if it is produced by a method using a pressing machine.

As previously described, in the PLP method, it is important to appropriately design a mold and to fill that mold with an alloy powder to produce a "near-net-shape" sintered magnet. For example, the shape and dimensions of the final product, and the degree of shrinkage of the alloy powder after it is sintered are taken into consideration when designing a mold to determine the shape and the dimensions of the space (mold cavity) which will be filled with the alloy powder. In some cases, a carbon material is used for the mold, in whole or in part, so that the shrinkage of the alloy powder during the sintering process will not be much impeded by the friction between the alloy powder and the mold (see Patent Document 3).

The following points should be taken into consideration when filling a mold cavity with an alloy powder. An alloy powder easily aggregates and forms bridges. Therefore, the density distribution of the alloy powder after filling is likely to be non-uniform. If the filling density of the alloy powder is not uniform, the "near-net-shape" property decreases and the magnetic properties deteriorate. Therefore, it is necessary to uniformly fill the mold cavity with the alloy powder. The degree of shrinkage of an alloy powder in a sintering process depends on the filling density of the alloy powder. Accordingly, the process of filling the mold cavity with an alloy powder must be performed in such a manner that the filling density of the alloy powder will be as supposed by the design of the mold since the mold design also takes into consideration the degree of shrinkage of the alloy powder, as previously described.

In many cases, the supply and filling of an alloy powder is performed by using a combination of an air (gas) tapping and a pusher or mechanical tapping device. Since an alloy powder easily aggregates as previously described, it is not possible to supply an accurate amount of alloy powder if an auto scale is used to measure the volume or the weight of the alloy powder, for example. In addition, due to its low fluidity, the alloy powder requires a long supply time. A gas tapping is a method in which a high-speed gas flow is repeatedly supplied from a supply hopper containing a powder to the supply space so as to provide the powder into the space at a uniform density (refer to Patent Document 4, for example), and is capable of rapidly providing an alloy powder of a predetermined volume. Since the powder density of the alloy powder when using the gas tapping is approximately within the range of 1.5 to 2.4 g/cm$^3$, a pusher or mechanical tapping device is also used to densify the alloy powder to a desired filling density.

The PLP method allows a production of a "near-net-shape" sintered magnet by the aforementioned process. However, when sintered magnets are actually produced on assembly lines, they may slightly vary in terms of shape and dimension.

The problem to be solved by the present invention is to provide a NdFeB system sintered magnet production system capable of producing a NdFeB system sintered magnet while keeping a high "near-net-shape" property.

Means for Solving the Problem

The inventors of the present invention have examined the specific causes of shape and dimension variation among the produced sintered magnets, and found that it is influenced by the shape and size of the particles of the alloy powder. The shape and size of the particles of the alloy powder used for the production of a sintered magnet are inconsistent. In addition, every time an alloy powder is prepared, there is a slight variation in the shape and size characteristics of the grains of the resulting alloy powder. For example, if the prepared powder contains a relatively large quantity of small-sized grains, these small grains of the alloy powder will enter the gaps among the larger grains of the alloy powder. In that case, even if a predetermined volume of alloy powder is supplied by a gas tapping or another method, more alloy powder than usual (that is, at a density more than usual) will be actually supplied.

The varying density of the alloy powder during supply variegates the filling density after densification, leading to variation in shape and dimension of the produced sintered magnets. Therefore, variations in the shape and size of the grains of the alloy powder must be controlled to accurately maintain the shape and dimensions of the produced sintered magnets.

Based on the aforementioned result of study, to solve the aforementioned problem, the present invention provides a NdFeB system sintered magnet production system for putting a NdFeB system alloy powder into a mold cavity of a mold which has been designed to correspond to a shape and dimensions of a product to a predetermined filling density within a range of 3.0 to 4.2 g/cm$^3$ and magnetically orienting and sintering the alloy powder being held in the mold cavity to produce a NdFeB system sintered magnet having the desired shape and dimensions, including:

a) a first weight measurer for measuring the weight of the mold before the alloy powder is put into the mold;

b) a supply cavity forming unit for providing the mold with a guide so as to extend the mold cavity to form a supply cavity with a predetermined volume;

c) a supplier for supplying the alloy powder into the supply cavity while adjusting a supply density so that the volume of the alloy powder is equal to the capacity of the supply cavity;

d) a densifier for pressing the alloy powder which has been supplied into the supply cavity into the mold cavity so as to densify the alloy powder to the filling density;

e) a second weight measurer for measuring the weight of the mold after the mold is filled with the alloy powder by the densifier; and f) a controller for computing a weight of the alloy powder which has been put into the mold cavity based on a difference between a measurement value by the first weight measurer and that by the second weight measurer, and, based on the computed weight, performing a feedback control of an alloy powder supply operation performed by the supplier.

"Pressing" the alloy powder into the mold cavity involves putting all the alloy powder contained in the supply cavity, the volume of which is equal to the capacity of the supply cavity, into the mold cavity while ensuring the alloy powder grains have a certain degree of freedom (i.e. a density at which they do not form a compact). The supply cavity incorporates the mold cavity and therefore has a larger capacity than the mold cavity. Since the capacity of the mold cavity is smaller than that of the supply cavity, "pressing" the alloy powder in the supply cavity into the mold cavity naturally densifies the alloy powder.

The alloy powder is supplied to the supply cavity while its density during the supply process (i.e. the weight during the supply process) is controlled by the controller so as to have the desired filling density after it is "pressed" into the mold cavity in its entirety. In the present application, the density during the supply process will be referred to as the "supply density," and the weight during the supply process as the "supply weight." The filling density of the alloy powder after densification is set to be in the range of 3.0 to 4.2 g/cm$^3$, but preferably in the range of 3.5 to 4.0 g/cm$^3$. The densifier may be realized by a mechanical tapping device or a pusher.

A gas tapping device may be preferably used as the supplier due to its capability of quickly supplying an alloy powder into a predetermined space at a uniform supply density, and easily controlling the supply density (i.e. supply weight) by means of the pressure of the gas flow supplied during the supply process.

The sintered magnet production system according to the present invention can also ascertain irregularities in the mold by using the mold weight measured before the alloy powder is put into the mold. Due to repeated use, a mold may have a defect such as a crack, or an alloy powder may stick to it during sintering. Since the system of the present invention measures the weight of the mold itself by the first weight measurer, irregularities in the mold accompanied by a weight change can be easily detected.

Effects of the Invention

The NdFeB system sintered magnet production system according to the present invention enhances the "near-net-shape" property of the produced sintered magnet by supplying and filling the mold with the alloy powder in such a manner that is not influenced by the shape and size of the alloy powder grains. It is difficult to supply an alloy powder into the mold while accurately measuring its weight as it easily aggregates, as previously described. Therefore, a method capable of uniformly supplying an alloy powder into a predetermined space while adjusting the supply density (supply weight) is used (such as gas tapping), and the supply density is feedback-controlled based on the change in the weight of the mold before and after it is filled with the alloy powder so as to supply and fill the mold with an accurate amount of alloy powder irrespective of the shape or size of the alloy powder.

BRIEF DESCRIPTION OF THE DRAWINGS

FIGS. 2A, 2B, 2C-1 through 2C-4, 2D, and 2E are schematic diagrams showing the operation of each unit of the powder supplying-filling unit of the present embodiment.

FIG. 3 shows an example of a characteristic curve illustrating the relationship between the control parameter of a powder supply unit and the supply weight of the alloy powder.

BEST MODE FOR CARRYING OUT THE INVENTION

Embodiment

Figure 1:
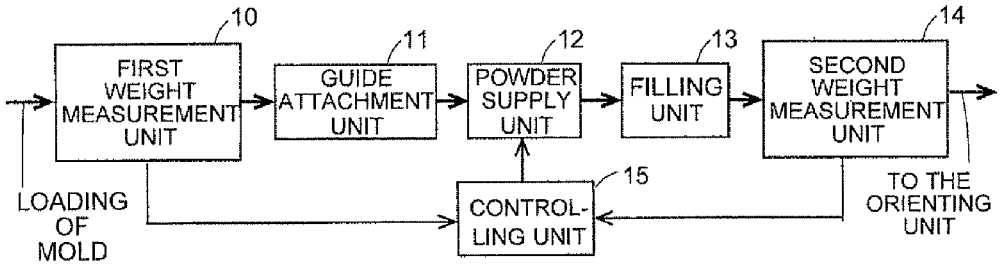
FIG. 1 is a block diagram showing an embodiment of a powder supplying-filling unit of the NdFeB system sintered magnet production system according to the present invention.

An embodiment of the NdFeB system sintered magnet production system according to the present invention will now be described with reference to FIGS. 1, 2A, 2B, 2C-1 through 2C-4, 2D, and 2E. FIG. 1 is a block diagram showing a powder supplying-filling unit for supplying and filling a mold with a NdFeB system alloy powder. After the mold is filled with an alloy powder at a predetermined filling density by the powder supplying-filling the alloy powder filling the mold is oriented and sintered respectively by an orienting unit and a sintering unit (which are not shown).

The powder supplying-filling unit of the present embodiment, which is shown in FIG. 1, has a first weight measurement unit 10, a guide attachment unit (a supply cavity forming unit) 11, a powder supply unit (the supplier) 12, a filling unit (the densifier) 13, a second weight measurement unit 14, and a controlling unit 15. The operation of these units will now be described with reference to FIGS. 2A, 2B, 2C-1 through 2C-4, 2D, and 2E.

Figure 2A:
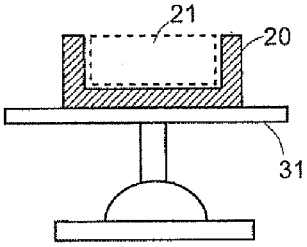

In the powder supplying-filling unit of the present embodiment, an empty mold 20 which has been loaded into the sintered magnet production system is first carried to the first weight measurement unit 10. The weight $W_1$ of the mold before it is filled with the alloy powder is measured by a scale 31 which is provided in the first weight measurement unit 10 (FIG. 2A).

Figure 2B:
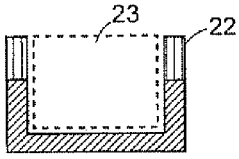

Having passed through the first weight measurement unit 10, the mold 20 is then carried to the guide attachment unit 11, where a guide 22 is attached thereto (FIG. 2B). As a result, the cavity of the mold 20 (mold cavity 21) and the space inside the guide 22 are connected to each other, thus forming a supply cavity 23. Next, in the powder supply unit 12, an alloy powder 32 is supplied into the supply cavity 23 from a supply hopper 33 (FIGS. 2C-1 through 2C-4). In the present embodiment, a gas tapping is used as the method for supplying the alloy powder 32 into the supply cavity 23. The supply method from the gas tapping is specifically described in such documents as Patent Document 4. Hereinafter, only an outline will be described.

Figures 1, 2C:
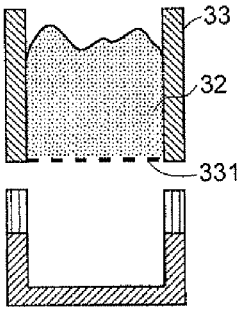
Figures 2, 2C:
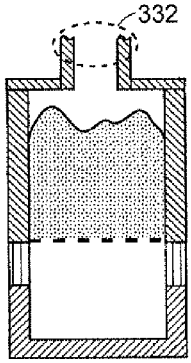
Figures 2, 2C, 3:
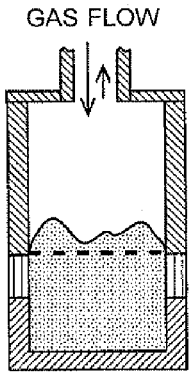
Figures 2, 2C, 3, 4:
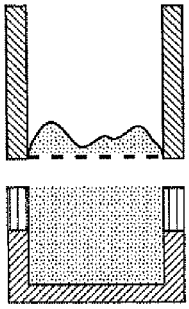

In the supply hopper 33, the alloy powder 32 is contained in the cylindrical container having openings on the upper and lower ends. A grid member 331 is attached to the lower opening (FIG. 2C-1). When a gas tapping process is performed, the supply hopper 33 is first placed on top of the guide 22 which has been attached to the mold 20, and a cover member provided with a gas injecting/drawing pipe 332 is put on the upper opening of the cylindrical container of the supply hopper 33. After that, a compressed gas is alternately introduced into and drawn from the cylindrical container of the supply hopper 33 through the gas injecting/drawing pipe 332 so as to transfer the alloy powder 32 to the supply cavity 23 (FIG. 2C-3).

By means of gas tapping, a powder layer of uniform density is formed without bridges in areas other than the upper portion, which is exposed to an intense current of air. Hence, by supplying the alloy powder 32 so as to leave the upper portion with non-uniform density in the supply hopper 33 (FIG. 2C-3), and by ultimately removing the portions with non-uniform density remaining in the supply hopper 33, it is possible to supply the alloy powder 32 into the supply cavity 23 at a uniform supply density and in the quantity equal to the capacity of the supply cavity 23 (FIG. 2C-4). In the gas tapping, the supply weight of the alloy powder supplied into the supply cavity 23 can be easily controlled by adjusting the pressure in the supply hopper, the tapping period (i.e. the period for repeating the injection and drawing of the compressed gas), the number of repetitions of the tapping, and other factors.

Figure 2D:
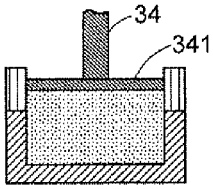

In the filling unit 13, the alloy powder 32 supplied into the supply cavity 23 is densified by being pushed into the mold cavity 21 with the pusher 34 (FIG. 2D). The powder supply unit 12 calculates and supplies the alloy powder 32 so that the alloy powder 32 will have the desired filling density when the powder in the supply cavity 23 is entirely transferred into the mold cavity 21. Therefore, it is only necessary to stop the pusher 34 at a level where the lower surface of the push plate 341 reaches the position of the upper surface of the mold cavity 21. In the PLP method, the filling density is adjusted to be within the range of 3.0 to 4.2 g/cm$^3$, but preferably within 3.5 to 4.0 g/cm$^3$. Thus, a sintered magnet without defect or deformation can be produced by the PLP method. After the alloy powder 32 is entirely transferred into the mold cavity 21, the guide 22, which is no longer necessary, is removed from the mold 20.

Figure 2E:
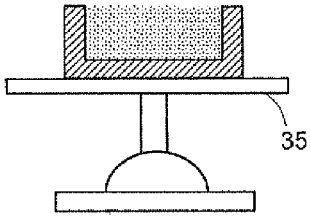
Figure 3:
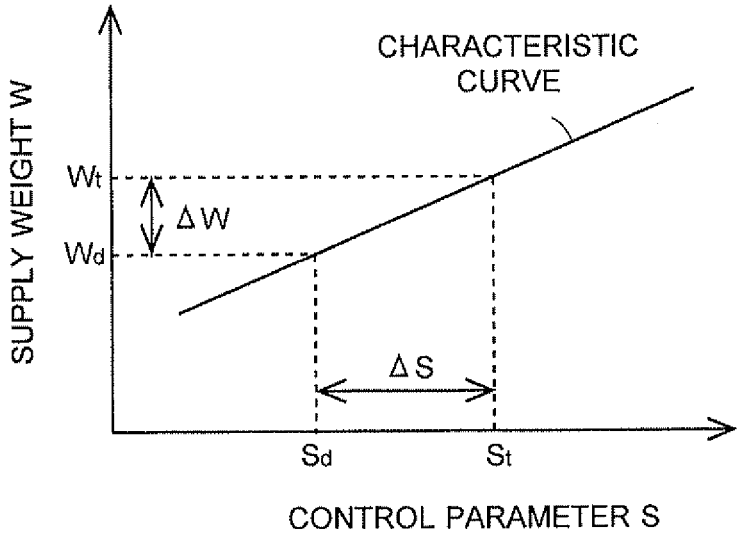

Finally, the weight $w_2$ of the mold 20, including the alloy powder 32 held in the mold cavity 21, is measured by the scale 35 provided in the second weight measuring unit 14 (FIG. 2E). After the measurement, the mold 20 is carried to the orienting unit and the sintering unit without any change, and the alloy powder 32 held in the mold 20 is oriented and sintered.

The controlling unit 15 computes the supply weight $W_d=w_2-w_1$ of the alloy powder at this point in time from the measurement values obtained from the first weight measurement unit 10 and the second weight measurement unit 14. Based on the computed value, the controlling unit 15 feedback-controls the supply weight of the alloy powder to be supplied to the supply cavity. The feedback control may be performed in such ways as the following.

First, a characteristic curve (FIG. 3), which shows the relationship between the supply weight W and the control parameter S for controlling the supply weight W of the powder supply unit 12, is prepared in advance for each product type with a different alloy composition. The curve is memorized in an internal memory of the controlling unit 15. In the case of a gas tapping, the control parameter may be the pressure in the supply hopper, the tapping period, the number of repetitions of the tapping, or another factor. The controlling unit 15 refers to the characteristic curve memorized in the internal memory and obtains the adjustment amount ΔS of the control parameter based on the difference between the current supply weight $W_d$, which has been computed from the measurement values of the first weight measuring unit 10 and the second weight measuring unit 14, and the target weight $W_t$ which has been established in advance. Then, the control parameter for the powder supply unit 12 is changed by ΔS from the current value, and the alloy powder 32 is supplied to a newly loaded mold 20.

It should be noted that the aforementioned feedback control method is merely an example, and it is evident that any modification, adjustment, or addition appropriately made within the spirit of the present invention is also included in the scope of the claims of the present application. For example, in the aforementioned feedback control, the data of the current supply weight are used to adjust the subsequent supply weight. However, the data of the supply weight for the previous N times (where N is an integer of one or more) including the current data may be stored, and their average value or weighted average value may be used to adjust the subsequent supply weight.

The controlling unit 15 may determine the defect of the mold 20 based on whether or not the measurement value of the mold weight obtained by the first weight measuring unit 10 is within a predetermined acceptable range.

Due to repeated use, the mold 20 may be broken or a portion of the alloy powder 32 may be stuck inside the mold cavity 21 in the sintering process. If some of the alloy powder 32 is stuck inside the mold cavity 21, for example, the capacity of the mold cavity 21 is changed, which deteriorates the "near-net-shape" property of the sintered magnet produced with this mold 20. If the mold 20 is broken, the alloy powder contained may leak from the breakage to the production system, which may cause an accident, such as a fire. Hence, the controlling unit 15 can eliminate a mold 20 from the system in advance whose measurement value obtained by the first weight measuring unit 10 is out of the acceptable range, so as to further increase the accuracy of the "near-net-shape" property of the produced sintered magnet, as well as the safety of the sintered magnet production system.

EXPLANATION OF NUMERALS

10 . . . First Weight Measurement Unit
11 . . . Guide Attachment Unit
12 . . . Powder Supply Unit
13 . . . Filling Unit
14 . . . Second Weight Measurement Unit
15 . . . Controlling Unit
20 . . . Mold
21 . . . Mold Cavity
22 . . . Guide
23 . . . Supply Cavity
31, 35 . . . Scale
32 . . . Alloy Powder
33 . . . Supply Hopper
331 . . . Grid Member
332 . . . Gas Injecting/Drawing Pipe
34 . . . Pusher
341 . . . Push Plate

The invention claimed is:

1. A NdFeB system sintered magnet production system for putting a NdFeB system alloy powder into a mold cavity of a mold which has been designed to correspond to a shape and dimensions of a product to a predetermined filling density within a range of 3.0 to 4.2 g/cm$^3$ and magnetically orienting and sintering the alloy powder being held in the mold cavity to produce a NdFeB system sintered magnet having the desired shape and dimensions, comprising:

a) a first weight measurer for measuring a weight of the mold before the alloy powder is put into the mold;

b) a supply cavity forming unit for providing the mold with a guide so as to extend the mold cavity to form a supply cavity with a predetermined volume;

c) a supplier for supplying the alloy powder into the supply cavity while adjusting a supply density so that a volume of the alloy powder is equal to a capacity of the supply cavity;

d) a densifier for pressing the alloy powder which has been supplied into the supply cavity into the mold cavity so as to densify the alloy powder to the filling density;

e) a second weight measurer for measuring a weight of the mold after being filled with the alloy powder by the densifier; and f) a controller for computing a weight of the alloy powder which has been put into the mold cavity based on a difference between a measurement value from the first weight measurer and that of the second weight measurer, and, based on the computed weight, performing a feedback control of an alloy powder supply operation performed by the supplier.

2. The NdFeB system sintered magnet production system according to claim 1, wherein the supplier uses a gas tapping.

3. The NdFeB system sintered magnet production system according to claim 2, wherein the controller controls at least one of a pressure of the gas tapping, a period of a tapping process, and a number of repetitions of the tapping.

4. The NdFeB system sintered magnet production system according to claim 1, wherein the densifier uses a mechanical tapping or a pusher.

5. The NdFeB system sintered magnet production system according to claim 1, wherein a density of the alloy powder which has been densified by the densifier is within a range of 3.5 to 4.0 g/cm$^3$.

6. The NdFeB system sintered magnet production system according to claim 1, wherein the controller determines an irregularity of the mold based on the measurement value of the weight of the mold obtained by the first weight measurer.

* * * * *